US008438887B2

(12) United States Patent
Sprague

(10) Patent No.: US 8,438,887 B2
(45) Date of Patent: May 14, 2013

(54) DOOR LOCK ASSEMBLY

(75) Inventor: Gary Sprague, Los Angeles, CA (US)

(73) Assignee: C.R. Laurence Company, Inc., Los Angeles, CA (US)

( * ) Notice: Subject to any disclaimer, the term of this patent is extended or adjusted under 35 U.S.C. 154(b) by 241 days.

(21) Appl. No.: 11/967,917

(22) Filed: Dec. 31, 2007

(65) Prior Publication Data

US 2009/0165508 A1 Jul. 2, 2009

(51) Int. Cl.
*E05B 13/10* (2006.01)

(52) U.S. Cl.
USPC ..... 70/210; 70/215; 70/224; 70/432; 70/448; 70/451; 70/DIG. 65; 292/336.3; 292/337; 292/347; 292/DIG. 53

(58) Field of Classification Search ..... 70/224, 70/432, DIG. 65, 452, 461, DIG. 31, DIG. 39, 70/DIG. 67, 210, 215, 448, 451, 466; 292/254, 292/DIG. 21, DIG. 30, DIG. 53, DIG. 54, 292/336.3, 337, 347
See application file for complete search history.

(56) References Cited

U.S. PATENT DOCUMENTS

| | | | | | |
|---|---|---|---|---|---|
| 756,447 | A * | 4/1904 | Von Wobsser | 292/337 |
| 1,346,670 | A * | 7/1920 | Page | 70/92 |
| 1,461,756 | A * | 7/1923 | Croning | 70/452 |
| 1,661,454 | A * | 3/1928 | Wilson | 70/448 |
| 1,674,841 | A * | 6/1928 | Schlage | 292/169.22 |
| RE18,399 | E * | 3/1932 | Wread | 292/169.22 |
| 2,010,237 | A * | 8/1935 | Joseph | 70/262 |
| RE21,025 | E * | 3/1939 | Schlage | 292/337 |
| 2,238,314 | A * | 4/1941 | Falk | 292/337 |
| 2,366,847 | A * | 1/1945 | Fendring | 292/254 |
| 2,518,207 | A * | 8/1950 | Wagner | 292/175 |
| 2,566,470 | A * | 9/1951 | Thomas | 292/337 |
| 2,815,833 | A * | 12/1957 | Cline | 70/152 |
| 2,899,819 | A * | 8/1959 | Rolph | 70/476 |
| 2,998,274 | A | 9/1959 | Russell | |
| 3,343,860 | A * | 9/1967 | Kohler | 292/169.16 |
| 3,872,696 | A * | 3/1975 | Geringer | 70/145 |
| 3,896,645 | A * | 7/1975 | Nagy et al. | 70/149 |
| 4,271,691 | A * | 6/1981 | Logan | 70/422 |
| 4,559,796 | A * | 12/1985 | De Forrest, Sr. | 70/432 |
| 4,563,885 | A * | 1/1986 | Madden | 70/97 |
| 5,024,070 | A * | 6/1991 | Toledo | 70/370 |
| 5,515,703 | A * | 5/1996 | Chance | 70/176 |
| 5,628,216 | A | 5/1997 | Qureshi et al. | |
| 6,067,823 | A * | 5/2000 | Ostergren | 70/210 |
| 6,120,071 | A * | 9/2000 | Picard et al. | 292/165 |
| 6,174,004 | B1 * | 1/2001 | Picard et al. | 292/165 |
| 6,449,994 | B1 * | 9/2002 | Kreyenborg | 70/101 |
| 6,993,945 | B1 * | 2/2006 | Chen | 70/472 |
| 7,578,531 | B1 * | 8/2009 | Leontaridis | 292/11 |

* cited by examiner

*Primary Examiner* — LLoyd Gall
(74) *Attorney, Agent, or Firm* — Mitchell P. Brook; McKenna Long & Aldridge LLP

(57) ABSTRACT

A door lock assembly for a door. The door lock assembly includes a handle assembly, a latch bolt assembly disposed within a portion of the handle assembly and a mounting assembly that movably couples the handle assembly to a door panel member. The latch bolt assembly includes a movable latch bolt that translates relative to the handle assembly between an extended position and a retracted position.

17 Claims, 6 Drawing Sheets

DOOR LOCK ASSEMBLY

FIELD OF THE INVENTION

The present invention relates to door lock assemblies.

BACKGROUND OF THE INVENTION

Doors are configured in many different ways, but no matter the door configuration, a lock mechanism that securely holds the door in place is frequently desired. Oftentimes when multiple doors are utilized unique locking challenges are presented. For example, swinging doors often are used for building or room entrances and are required to lock to each other rather than a stationary frame or jamb. Because there is no stationary frame or jamb the doors require a more robust and unique locking mechanism.

Movable wall panels are also often used for building or room entrances and also present significant locking challenges. Movable wall panels are used to divide an area into two or more regions. For example, movable wall panels are employed in schools, hotels, and convention centers to divide a large room into two or more smaller rooms. Another common use of movable wall panels is the formation of individual shop fronts within a mall. Clear glass panels are typically stored during business hours to produce a wide-open storefront, and are disposed in front of the storefront during off-business hours or during inclement weather to permit the viewing of merchandise.

Movable wall panel systems typically include several components, such as wall panels, trolleys coupled to the wall panels, and tracks within which the trolleys can slide and displace the wall panels. The wall panels often are large planar structures that may be freestanding or attached to one another end-to-end. Many modern applications of wall panel systems utilize freestanding wall panels in order to allow greater versatility over systems using wall panels that are attached end-to-end. Oftentimes one or a pair of panels of the wall panel system is designed so that it may be converted into a pivoting configuration thereby creating a single or a pair of swinging doors. As a result, even when the movable wall panels are disposed in front of the storefront, access into the store may still be provided. In that pivoting configuration the problems with swinging doors described above are experienced.

Traditional door lock assemblies generally are not well-suited to vertically frameless glass movable wall panels or vertically frameless glass swinging doors. Door lock assemblies generally include an inner knob, an outer knob and a latch bolt assembly that is fixedly mounted within a cavity included in a door panel and that is actuated by turning the inner or outer knob. The latch bolt assembly includes a retractable latch bolt and a retractor. The inner and outer knobs are coupled to surfaces of a door panel and rotate together relative to the panel. The retractor couples the latch bolt assembly and the knobs so that rotation of the knobs relative to the door panel causes the retractable latch bolt to extend out of the door panel.

Traditional door locks present significant disadvantages when used with vertically frameless glass doors. First, the latch bolt assembly is disposed in a cavity in the door panel. Because of that, the door panel must have a thickness sufficient to house the latch bolt assembly. Otherwise, a separate housing must be provided to house the latch bolt assembly and to fixedly attach it to the glass door panel, thereby interrupting the vertical glass edge, which significantly diminishes the door's aesthetic appeal. Another disadvantage is that requiring sufficient space in the door to house a door latch assembly is not desired where a glass door panel is employed and it is desired to have a see-through partition. A still further disadvantage is that configuring a cavity within a material adds significant difficulty to the manufacture of a door panel.

There is also a need for a door lock system that does not increase the effective thickness of the door panel or minimally does so.

There is a further need for a door lock system that simplifies manufacture of a door panel assembly.

There is yet a further need for a door lock system that reduces impairment of the transparent surface area of transparent doors.

SUMMARY OF THE INVENTION

The present invention alleviates to a great extent the disadvantages of known door lock systems by providing a door lock system and related method of use, in which one or more door panel assemblies are provided with a door lock system that includes a latch bolt assembly that is movable relative to a door panel member. In particular, the latch bolt assembly is coupled to a handle assembly that is movably mounted to the door panel member, which does not interrupt the vertical glass edge when in the unlocked position.

In an embodiment, a door lock assembly for mounting to a panel member of a door panel assembly includes a mounting assembly, a handle assembly, and a latch bolt assembly. The handle assembly is rotatably coupled to the mounting assembly and includes a gripping portion and a latch housing. The latch bolt assembly includes a latch bolt that is movably coupled to the latch housing so that the latch bolt is configured to translate between an extended position and a retracted position. In the extended position, the latch bolt is at least partially extended from the latch housing. In the retracted position, the latch bolt is retracted into the latch housing.

In another embodiment, a door panel assembly includes a panel member, a mounting assembly, a handle assembly and a latch bolt assembly. The mounting assembly is fixedly coupled to the panel member. The handle assembly is rotatably coupled to the mounting assembly and includes a gripping portion and a latch housing. The latch bolt assembly includes a latch bolt that is movably coupled to the latch housing such that the latch bolt is configured to translate between an extended position and a retracted position. In the extended position, the latch bolt at least partially extends from the latch housing. In the retracted position, the latch bolt is retracted into the latch housing.

In another embodiment, door panel assembly includes first and second panel members, first and second mounting assemblies, first and second handle assemblies and a latch bolt assembly. The first panel member is configured to pivot about a first axis of rotation. The second panel member is configured to pivot about a second axis of rotation. The first mounting assembly is fixedly coupled to the first panel member. The first handle assembly is rotatably coupled to the first mounting assembly and includes a first gripping portion and a first latch housing. The latch bolt assembly includes a latch bolt that is movably coupled to the latch housing such that the latch bolt is configured to translate between an extended position and a retracted position. In the extended position, the latch bolt at least partially extends from the latch housing. In the retracted position, the latch bolt is retracted into the latch housing. The second mounting assembly is fixedly coupled to the second panel member. The second handle assembly is rotatably coupled to the second mounting assembly and includes a second gripping portion and a second latch housing that defines a latch bolt cavity. The latch bolt cavity is configured to slidably receive the latch bolt when the first handle assembly is rotated to a locked position, the second handle assembly is rotated to a locked position and the latch bolt is in the extended position.

These and other features and advantages of the present invention will be appreciated from a review of the following detailed description of the invention, along with the accompanying figures in which like reference numerals refer to like parts throughout.

DETAILED DESCRIPTION OF THE INVENTION

Figure 1:
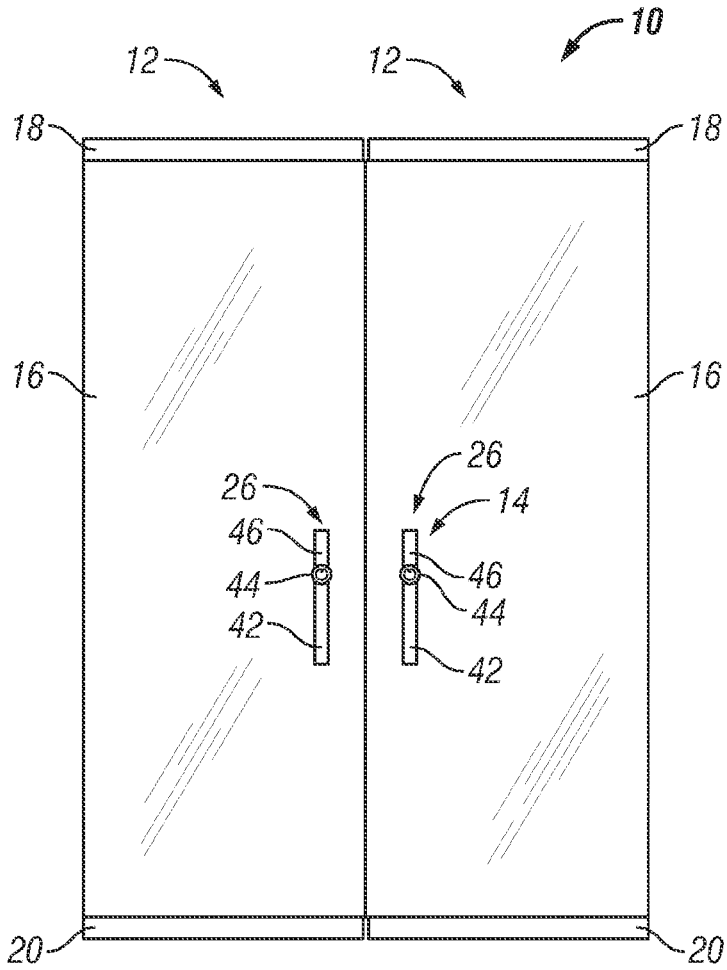
FIG. 1 is a front view of a door panel assembly incorporating the door lock in accordance with the present invention in an unlocked position.

The door lock assembly of the present invention may be used in any type of pivoting door assembly. For example and with reference to FIG. 1, a double door panel assembly including an embodiment of the door lock assembly 14 of the present invention will be described. The double door panel assembly may be included in a movable wall panel system or it may be a stand-alone pair of double doors that is mounted within a stationary door jamb.

Door panel assembly 10 includes a pair of door panels 12 and a door lock assembly 14. Each door panel 12 is generally pivotally mounted in a door frame, or opening, with the pivot locations on opposite ends of the door frame so that the door panels 12 open away from each other and meet in a generally aligned closed position.

Each door panel 12 includes a panel member 16, an upper rail 18 and a lower rail 20. Door panel 12 is constructed so that it forms a partition when suspended in the door opening and is in a closed position. Panel member 16 may be constructed from any material suitable for providing a physical barrier, such as glass, wood, metal, composites or any combination thereof. In a preferred embodiment, panel member 16 is constructed from tempered glass so that it provides a transparent, or at least partially transparent, physical barrier.

Upper rail 18 and panel member 16 are mechanically coupled so that upper rail 18 is fixedly located on an upper portion of panel member 16. Upper rail 18 and panel member 16 may be coupled such that panel member 16 can be suspended from upper rail 18 if desired. Upper rail 18 generally includes a channel that receives an upper edge of panel member 16. Upper rail 18 and panel member 16 may be coupled by mechanical clamping, bonding or other fasteners that are sufficient to assure that panel member 16 is fixed relative to upper rail 18 and, if desired, to support the weight of panel member 16 and any additional hardware mounted on panel member 16.

Similarly, lower rail 20 is mechanically coupled to panel member 16 so that panel member 16 may be supported from below by lower rail 20. Lower rail 20 includes a channel that receives a lower edge of panel member 16 and the parts are coupled by mechanical clamping or bonding such that relative motion between panel member 16 and lower rail 20 is prevented. It should be appreciated that a small amount of relative motion between panel member 16 and one or both of upper rail 18 and lower rail 20 may be permitted, if desired, such as to allow relative expansion or contraction of the parts.

Upper and lower rails 18 and 20 may be constructed from any rigid material such as steel, composites and aluminum, or other non-ferrous metals, and generally include a longitudinal channel for receiving a respective upper or lower edge of panel member 16. Furthermore, upper and lower rails 18 and 20 may house clamping mechanisms that allow wall panel 16 to be mechanically coupled to a respective rail. Additionally upper and lower rails 18 and 20 may be provided in any desired finish. For example, the rails may be provided in a satin finish, bronze, stainless steel, etc. It should further be recognized that although upper and lower rails 18 and 20 are illustrated as extending the full length of an edge of a respective panel member 16, the length of the rail may vary and need not be the full length of a side of a respective panel member 16.

Door lock assembly 14 selectively locks the two adjacent door panels 12 when door panels 12 are in a closed position. Door lock assembly 14 is configured so that panel member 16 requires minimal modification in order to mount door lock assembly 14 thereon and minimally affects the aesthetics of panel member 16. In particular, a latch bolt assembly 28 is mounted in a portion of the door lock assembly that is movable relative to panel member 16 instead of directly to or within a wall panel. As a result, the latch bolt assembly may be provided that is not required to be housed by the panel member or a separate housing coupled to the panel member.

Figure 2:
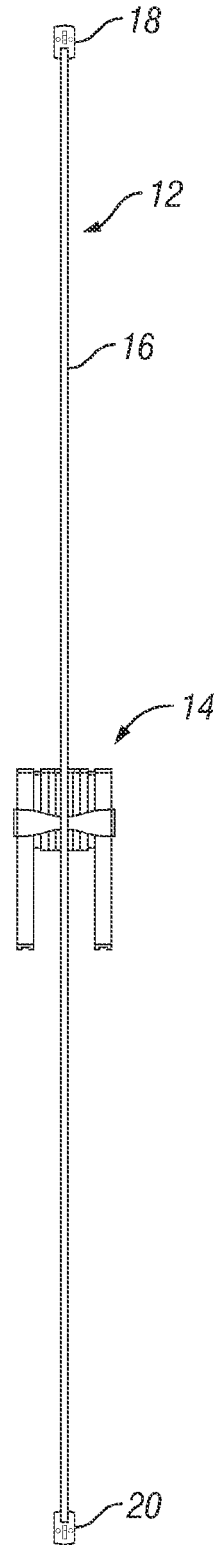
FIG. 2 is a side view of the door panel assembly of FIG. 1.
Figure 3:
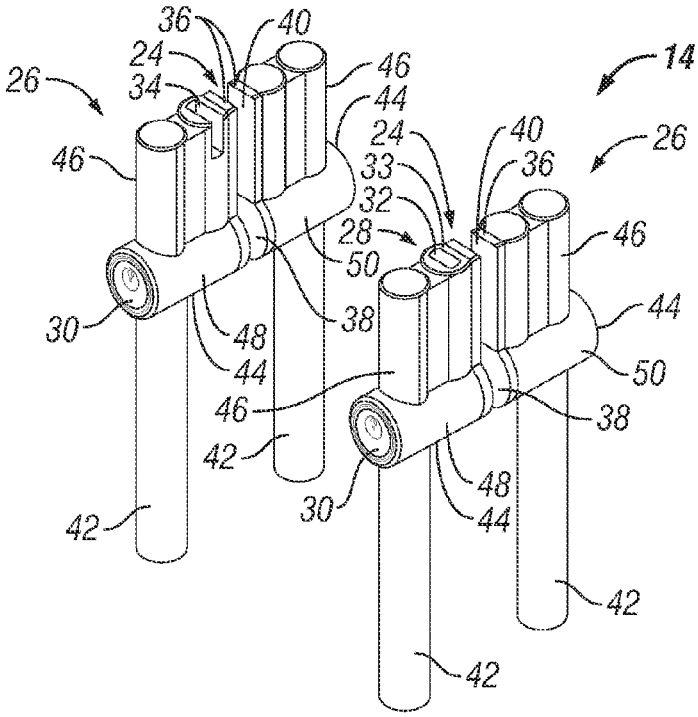
FIG. 3 is a perspective view of the door lock of FIG. 1.

When door lock assembly 14 is in an unlocked position, as shown in FIGS. 1-3, door lock assembly 14 provides a convenient gripping portion for a user to manually pivot one or both door panels 12. Door lock assembly 14 generally includes a pair of mounting assemblies 24, a pair of handle assemblies 26, a latch bolt assembly 28 and a pair of lock cylinder assemblies 30.

Mounting assemblies 24 provide a mechanism for mounting handle assemblies 26 to panel members 16. Mounting assemblies 24 are fixedly mounted onto respective panel members 16. In the present embodiment, each mounting assembly 24 comprises a pair of mounting plates 36 that are disposed on opposite outer surfaces of panel member 16 so that a portion of panel member 16 is interposed between mounting plates 36.

Mounting plates 36 are fixedly coupled to panel member 16 so there is no relative movement between panel member 16 and mounting assembly 24. For example, mounting plates 36 may be fixedly coupled to each other and configured to clamp wall panel there between, such as by fasteners that engage each of mounting plates 36 and extend through holes included in panel member 16. As another alternative, mounting plates 36 may be bonded directly to panel member 16 or mechanically fixed directly to panel member 16 by fasteners that engage a portion of panel member 16.

Mounting plates 36 may be any shape. In the present embodiment, mounting plates 36 include a circular portion 38 and a rectangular tab 40 that extends away from the circular portion 38. Mounting plates 36 may be shaped so that there is space for desired markings, such as indicia showing whether door lock assembly 14 is locked or unlocked, or to simplify coupling of mounting assembly 24 to panel member 16. For example and as will be described in greater detail below, when door lock assembly 14 is operated, handles 26 are rotated relative to mounting assembly 24 about an axis of rotation. The shape of mounting plates 36 may be selected so that they are fixedly coupled to panel member 16 at a distance from the axis of rotation so that less coupling force is required to prevent mounting assembly 24 from rotating with handle assemblies 26 during operation.

Handle assemblies 26 include gripping portions 42, lock housings 44 and latch housing portions 46. The handle assemblies 26 are configured to rotate relative to mounting assemblies 24 and panel member 16 about an axis of rotation. Each handle assembly 26 includes a pair of gripping portions 42 that provide a push and/or pull surface during opening and closing of door panel 12. Gripping portions 42 extend away from the axis of rotation and are sized so that a user may easily grasp that portion. Furthermore, gripping portions 42 are disposed on either side of panel member 16 and are coupled so that gripping portions 42 rotate together. As a result, a user on either side of panel member 16 may operate door lock assembly 14.

As illustrated in the present embodiment, gripping portions 42 are generally cylindrical rods that extend away from the axis of rotation. However, it should be appreciated that gripping portions 42 may be any desired size and shape. For example, gripping portions 42 may be straight, curved, or angled levers, bulbous knobs or any other desired configuration.

Lock housing 44 is disposed at an end of gripping portion 42 and is configured to receive lock cylinder 30. In the present embodiment, lock housing 44 is a generally cylindrical tube that is disposed so that its longitudinal axis is coincident with the axis of rotation of handle assembly 26. The configuration of lock housing 44 in part depends upon the desired configuration of lock cylinder. For example, lock cylinder 30 may be configured so that it may be operated from either side of panel member 16. In such an embodiment, lock housing 44 includes a first portion 48 on a first side of panel member 16 and a second portion 50 on a second side of panel member 16 and lock cylinder 30 extends through first portion 48, panel member 16 and second portion 50. First and second portions 48 and 50 are generally tubular and may have any cross-sectional shape selected to receive a desired lock cylinder 30.

Alternatively, lock cylinder 30 may be configured so that it is operated from one side of panel member 16 only. Accordingly, lock housing 44 need only be provided on one side of panel member 16. A dummy portion of lock housing 44 may be included on the other side of panel member 16 so that the portions of handle assembly 26 on both sides of panel member 16 are generally identical and/or to provide a convenient mounting location for gripping portion 42 and/or latch housing portion 46.

It should be appreciated that various configurations of lock cylinder 30 may be provided. For example, lock cylinder 30 may be keyed, may include an actuating lever or tab that allows a user to selectively lock and unlock lock cylinder 30 or may be electronically or electromechanically actuated. Additionally, lock cylinder 30 may be configured to selectively prevent relative motion between handle assembly 26 and mounting assembly 24 when handle assembly 26 is in either a locked or unlocked position relative to mounting assembly 24. Alternatively, lock cylinder 30 may be configured to directly control the position of a latch bolt 32 relative to the remainder of handle assembly 26.

Latch housing 46 extends from lock housing 44 and provides a structure for mounting latch bolt assembly 28 or a structure defining latch bolt cavity 34 within handle assembly 26. As shown, in a door panel assembly 10 including a pair of adjacent door panels 12, a first handle assembly 26 of a first door panel 12 includes latch housing 46 that receives a portion of latch bolt assembly 28 that includes a movable latch bolt 32. As a result, latch bolt assembly 28 is housed entirely within handle assembly 26 and latch bolt assembly 28 rotates with handle assembly 26. A second handle assembly 26, that is part of a second door panel 12, includes latch housing 46 that defines latch bolt cavity 34 that is sized and located on the second handle assembly 26 so that movable latch bolt 32 is received by latch bolt cavity 34 when the adjacent handle assemblies 26 are in a locked position and latch bolt 32 is in an extended position.

Handle assembly 26 may include a dummy latch housing if desired so that portions of handle assembly 26 on either side of panel member 16 are generally identical. It should be appreciated that the portions of handle assembly 26 on each side of panel member 16, i.e., gripping portion 42, lock housing 44 and latch housing 46, may be constructed from individual components that are mechanically coupled or machined as a monolithic body. Therefore, dummy portions, such as dummy lock housings 44 and/or dummy latch housings 46 may be included to simplify the manufacturing process. In an embodiment, lock housing 44 and latch housing 46 are machined as a monolithic body while gripping portion 42 is a separate component that is mechanically coupled to the monolithic body. Such a configuration also simplifies manufacture so that a single lock and latch housing unit may be used with gripping portions having different configurations.

Latch bolt assembly 28 includes a body portion 33 and latch bolt 32. Latch bolt 32 is movably coupled to body portion 33 so that latch bolt 32 may be translated along a translation axis between an extended position and a retracted position relative to body portion 33. As a result, body portion 33 of latch bolt assembly 28 is configured to rotate with handle assembly 26 relative to mounting assembly 24, while latch bolt 32 is configured to rotate with handle assembly 26 relative to mounting assembly 24 and to translate relative to handle assembly 26. As a result, latch bolt 32 follows an arcuate path during operation that does not have a constant radius.

In an embodiment, latch bolt assembly 28 is configured so that relative rotation between handle assembly 26 and mounting assembly 24 causes latch bolt 32 to translate relative to body portion 33. Alternatively, latch bolt assembly 28 may be configured so that latch bolt 32 may be extended and retracted regardless of relative rotation between handle assembly 26 and mounting assembly 24, such as by operating a respective lock cylinder 30. In a preferred embodiment shown in FIG. 6 handle assembly 26 will be indexed relative to the mounting assembly by means of a small spring loaded slide bolt assembly 52 extending from lock housing 44. This slide bolt 52 must be retracted to disengage the mounting assembly, thereby permitting rotation of the handle assembly into the locked position.

The size and shape of latch bolt cavity 34 are selected so that latch bolt 32 is slidably received therein during operation. When latch bolt 32 is received within cavity 34, that engagement prevents relative motion between the adjacent panel members 16. Latch bolt cavity 34 is generally a bore that extends into latch housing 46. In the present embodiment, the cross-sectional shape of cavity 34 is rectangular to match the generally rectangular cross-sectional shape of latch bolt 32. Cavity 34 may be opened on one or more sides. As shown in FIG. 3, cavity 34 is open on two adjacent sides and it should be apparent from the description of the operation of door lock assembly 14 that such a configuration is necessary when handle rotation causes latch bolt extension. In some embodiments only one side is open for aesthetic reasons, which requires latch bolt extension via lock cylinder rotation.

As shown in FIGS. 1-3, door lock assembly 14 is illustrated in an unlocked position. In the unlocked position, handle assemblies 26 are rotated to a position in which gripping portion 42 and the translation axis of latch bolt 32 are vertical. In that configuration gripping portions 42 of the adjacent handle assemblies 26 are generally parallel. Lock cylinders 30 are configured so that handle assemblies 26 may be locked in either an unlocked or locked position.

Figure 4:
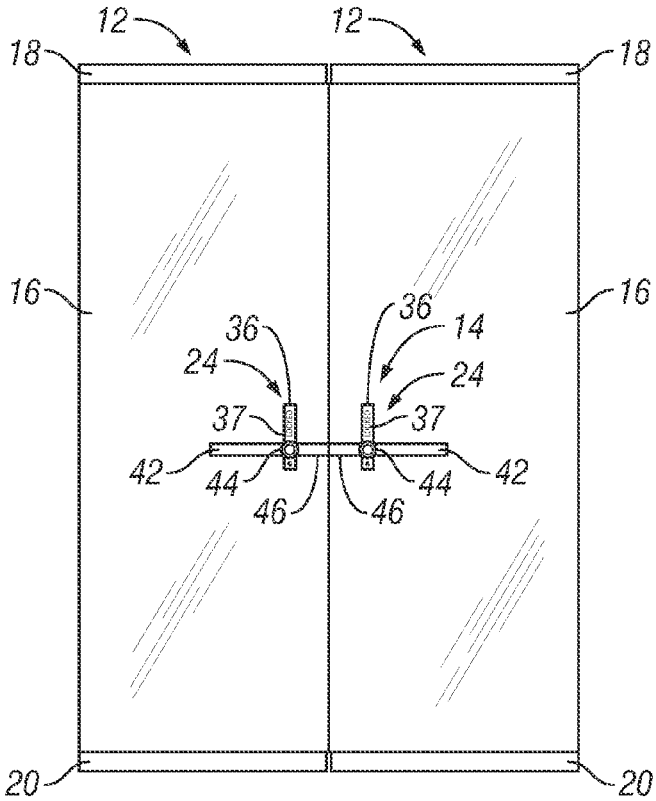
FIG. 4 is a front view of the door panel assembly of FIG. 1 incorporating a lock in accordance with the present invention in a locked position.
Figure 5:
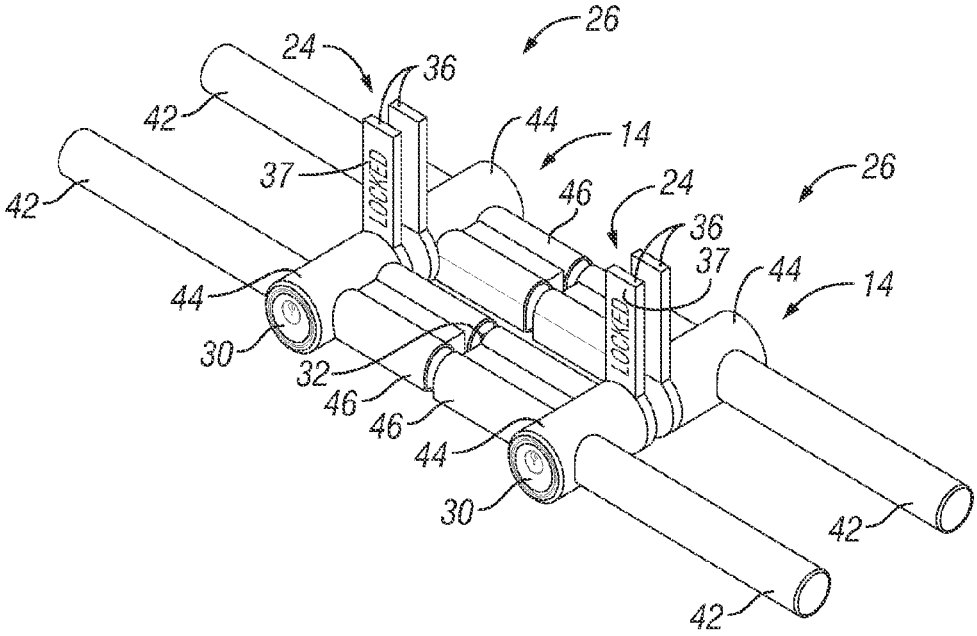
FIG. 5 is a perspective view of the door lock of FIG. 4.

When a user desires to place door lock assembly 14 in a locked position, according to one method of operation, the user first unlocks handle assemblies 26 so that they may be rotated relative to mounting assemblies 24 and panel members 16. Next, the adjacent handle assemblies 26 are rotated in opposite directions of rotation until gripping portions 42 are generally aligned along a common axis, as shown in FIGS. 4 and 5. In an embodiment, rotation of handle assembly 26 relative to mounting assembly 24 results in latch bolt 32 translating relative to and extending from latch body 33 while latch bolt assembly 28 rotates with handle assembly 26. During rotation of the adjacent handle assemblies 26, latch housings 46 are moved toward each other. The movement of latch housings 46 toward each other and the simultaneous extension of latch bolt 32 out of latch body 33 results in latch bolt 32 extending into latch bolt cavity 34.

Because latch bolt cavity 34 is opened on two sides, the rotation of the adjacent handles need not be precisely timed. In particular, the configuration of latch bolt cavity 34 allows handle assembly 26 that includes latch bolt cavity 34 to be rotated to the locked position after handle assembly 26 including latch bolt 32 is already in the locked position with latch bolt 32 fully extended from latch body 33.

Figure 6:
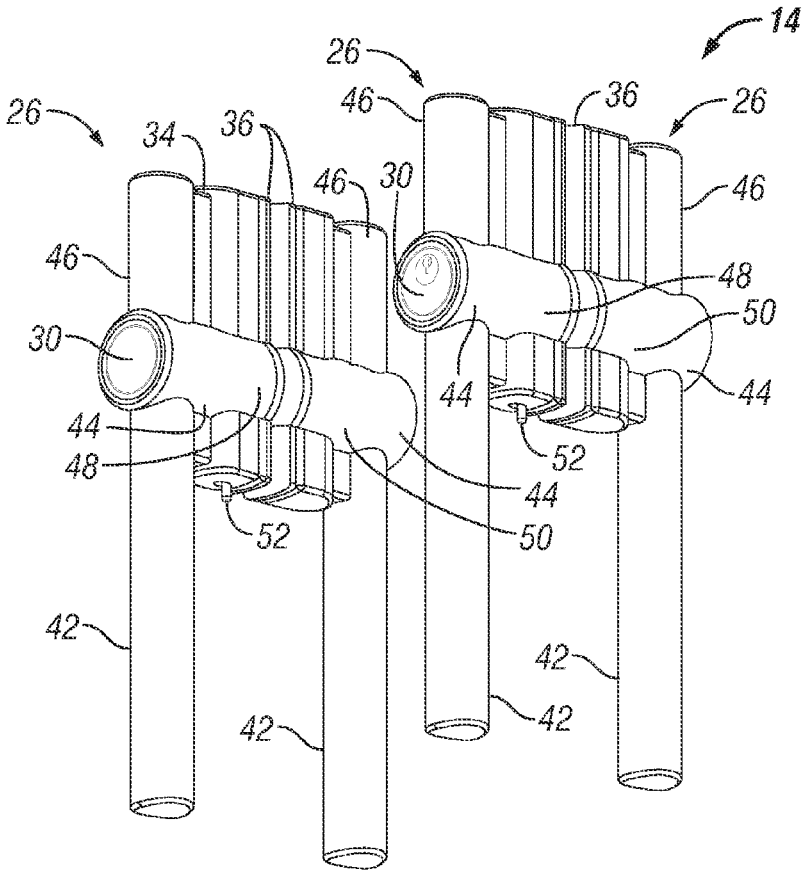
FIG. 6 is a perspective view of an alternative embodiment of the door lock assembly in accordance with the present invention.
Figure 7:
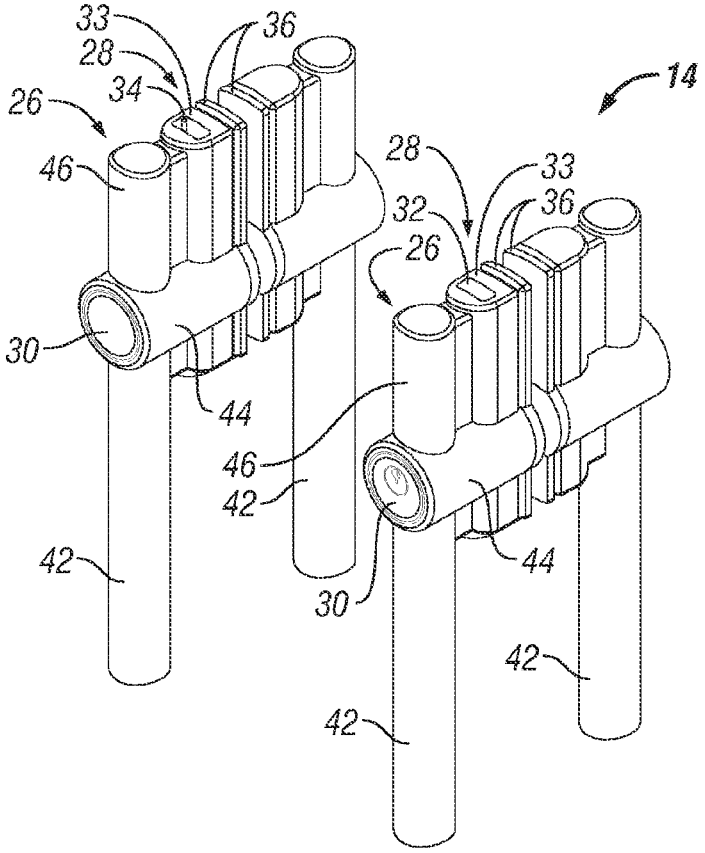
FIG. 7 is a perspective view of the door lock of FIG. 6.
Figure 8:
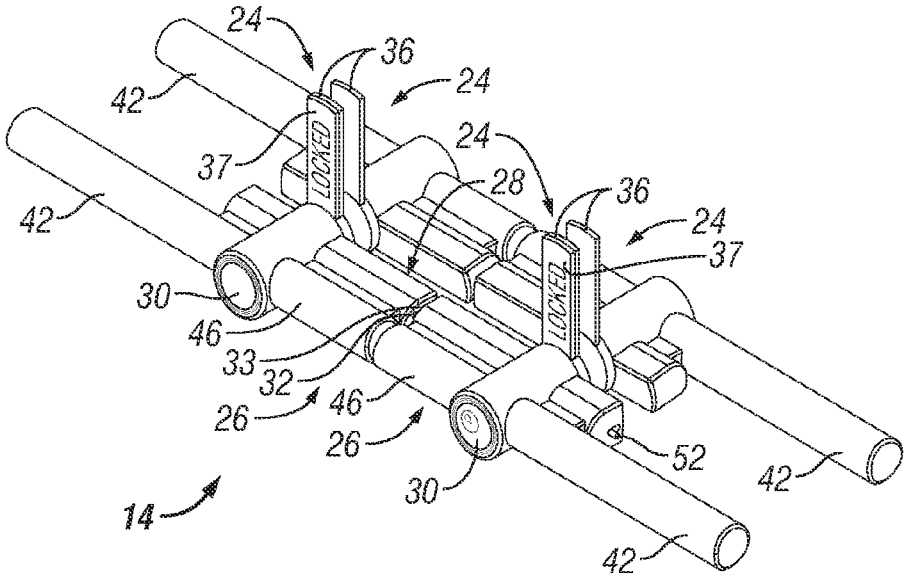
FIG. 8 is a perspective view of the door lock of FIG. 6 in a locked position.

In a preferred embodiment shown in FIGS. 6-8, handle assembly 26 may be indexed relative to the mounting assembly by means of a small spring loaded slide bolt assembly 52 extending from lock housing 44. Similar to previous embodiments, mounting assembly 24 comprises a pair of mounting plates 36. Latch bolt cavity 34 is a bore that extends into latch housing 46. In this embodiment, cavity 34 is enclosed within body portion 33 of latch bolt assembly 28 such that it has no side openings. Latch bolt assembly 28 also may comprise an indexing pin assembly including an indexing pin 52 extending from lock housing 44 so that handle assembly 26 may be indexed relative to the mounting assembly. This indexing pin 52 must be retracted to disengage the mounting assembly, thereby allowing rotation of the handle assembly relative to the mounting assembly and into the locked position. The indexing pin assembly extends into the latch bolt assembly 28 and may include an interior indexing feature (not shown) to allow rotation of handle assembly 26 relative to mounting assembly 24 when the slide bolt is retracted. In some embodiments, the indexing feature comprises a spring loaded mechanism that includes a detent.

To lock door lock assembly 14, indexing pin 52 is retracted, then handle assemblies 26 are rotated relative to mounting assemblies 24 and panel members 16. The adjacent handle assemblies 26 are then rotated in opposite directions of rotation until gripping portions 42 are generally aligned along a common axis. Rotation of the adjacent handle assemblies 26 causes latch housings 46 to be moved toward each other. Because latch bolt cavity 34 does not have side openings, the rotation of the adjacent handles must be precisely timed so latch housings 46 are directly across from each other and latch bolt 32 is aligned with cavity 34. Latch bolt 32 is extended into, and retracted from cavity 34 by key operation of lock cylinder 30.

As shown in FIGS. 5 and 8, door lock assembly 14 may include an optional indicia 37 designating whether door lock assembly 14 is in a locked or unlocked configuration. In particular, indicia 37 is included on mounting plate 36 and located so that relative rotation of handle assembly 26 into the locked position exposes indicia 37. When handle assembly 26 is in an unlocked position, latch housing 46 covers indicia 37 so that it can not be seen. As shown, indicia 37 may be a written indication of the locked configuration of door lock assembly 14, i.e., indicia 37 is the word "locked" disposed on mounting plate 36. Indicia 37 may be printed, etched, engraved, molded or created on mounting plate 36 by any known manufacturing method.

Furthermore, it should be appreciated that indicia 37 need not be a printed word. For example, indicia 37 may be a symbol, such as a pictograph of a lock in a locked configuration, or a color, such as red. It should further be appreciated that although the illustrated embodiment includes indicia 37 designating that door lock assembly 14 is in a locked configuration, indicia may alternatively or additionally be provided that indicates that door lock assembly 14 is in an unlocked configuration.

Figure 9:
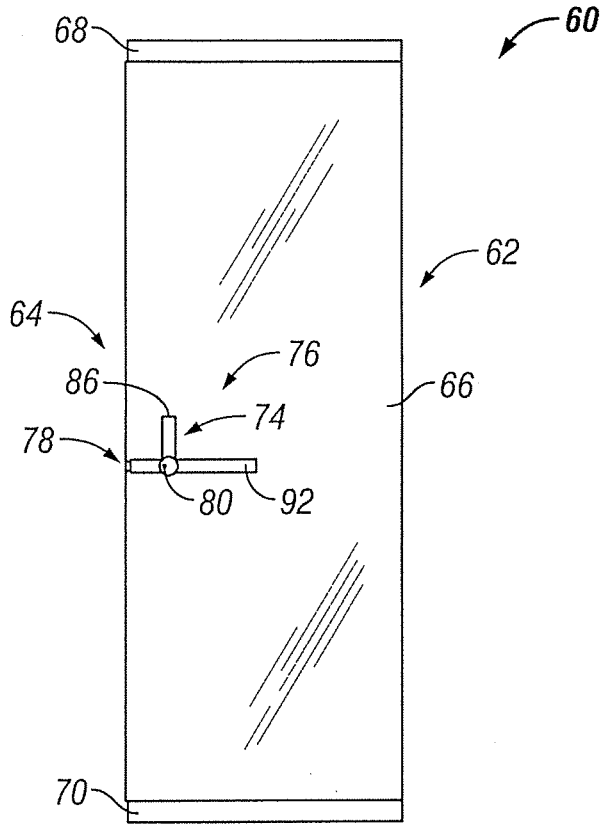
FIG. 9 is a front view of a door panel assembly incorporating a lock in accordance with the present invention in a locked position.
Figure 10:
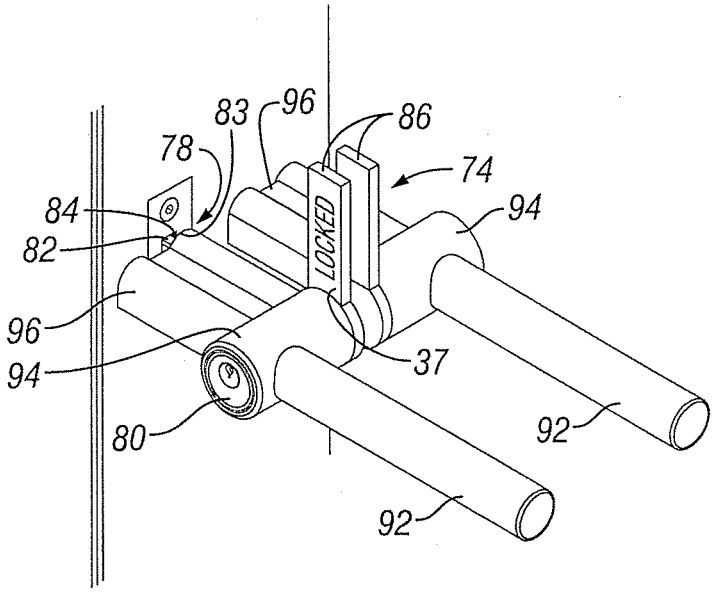
FIG. 10 is a perspective view of the door lock of FIG. 9.
Figure 11:
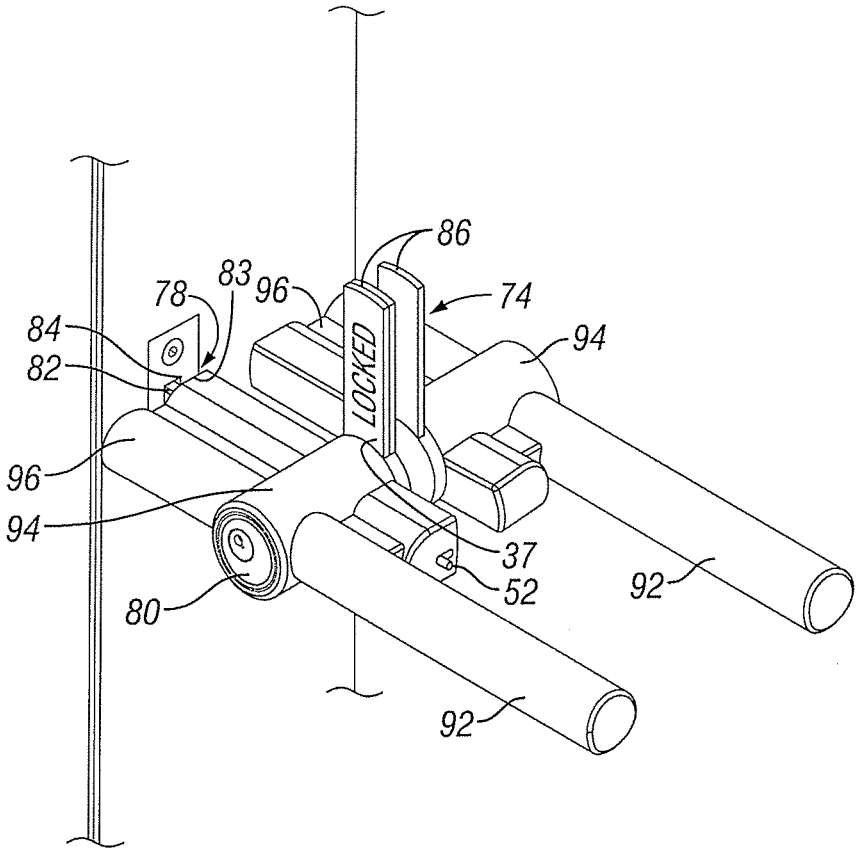
FIG. 11 is a perspective view of an alternative embodiment of the door lock of FIG. 9.

Referring to FIGS. 9-11, door panel assembly 60 will be described. In the present embodiment, door panel assembly 60 includes a single door panel 62 that has a single panel member 66. Door panel assembly 60 may be used in any application that requires a single-width door. For example, door panel assembly 60 may be used as a single-width door entry in a single-width door jamb or door panel assembly 60 may be used in a wall partition system in which a single-width door entry is desired.

Door panel assembly 60 generally includes upper rail 68, lower rail 70, panel member 66 extending there between and door lock assembly 64. Door panel assembly 60 is pivotally coupled in a door opening so that it is rotatable between an opened position and a closed position.

In the present embodiment, a single handle assembly 76 is mounted to panel member 66. Mounting assembly 74 is fixedly coupled to panel member 66 and handle assembly 76 is rotatably coupled to mounting assembly 74. Similar to previous embodiments, mounting assembly 74 comprises a pair of mounting plates 86 that are disposed on opposite outer surfaces of panel member 66 so that a portion of panel member 66 is interposed between mounting plates 86.

Mounting plates 86 are fixedly coupled to panel member 66 so there is no relative movement between panel member 66 and mounting assembly 74. For example, mounting plates 86 may be fixedly coupled to each other and configured to clamp panel member there between, such as by fasteners that engage each of mounting plates 86 and extend through holes included in panel member 66. As another alternative, mounting plates 86 may be bonded directly to panel member 66 or mechanically fixed directly to panel member 86 by fasteners that engage a portion of panel member 66. Mounting plates 86 may be any shape, size and material.

Similar to the previously described embodiments, handle assembly 76 includes gripping portion 92, lock housings 94 and latch housing portions 96. Handle assembly 76 is configured to rotate relative to mounting assembly 74 and panel member 16, about an axis of rotation. Handle assembly 76 includes a pair of gripping portions 92 that provides push and/or pull surfaces during opening and closing of door panel 62. Gripping portions 92 extend radially away from the axis of rotation and are sized so that a user may easily grasp that portion. Furthermore, gripping portions 92 are disposed on either side of panel member 66 and are coupled so that gripping portions 92 rotate together. As a result, a user on either side of panel member 66 may operate door lock assembly 64. Gripping portions 92 may be straight, curved, or angled levers, bulbous knobs or any other desired configuration.

Lock housing 94 is disposed at an end of gripping portion 92 and is configured to receive lock cylinder 80 which may have any desired configuration. Latch housing 96 extends from lock housing 94 and provides a structure for mounting latch bolt assembly 78. Handle assembly 76 may include a dummy latch housing, if desired, so that portions of handle assembly 76 on either side of panel member 66 are generally identical.

Because door panel assembly 60 includes only a single door panel 62, latch bolt cavity 84 is defined as a vertical surface adjacent door panel 62. For example, latch bolt cavity 84 may be included in the vertical surface of a doorjamb.

It should be appreciated that the portions of handle assembly 76 on each side of panel member 66, i.e., gripping portion 92, lock housing 94 and latch housing 96, may be constructed from individual components that are mechanically coupled or machined as a monolithic body. Therefore, dummy portions, such as dummy lock housings 94 and/or dummy latch housings 96 may be included to simplify the manufacturing process. In an embodiment, lock housing 94 and latch housing 96 are machined as a monolithic body while gripping portion 92 is a separate component that is mechanically coupled to the monolithic body. Such a configuration also simplifies manufacture so that a single lock and latch housing unit may be used with gripping portions having different configurations.

Latch bolt assembly 78 includes a body portion 83 and latch bolt 82. Latch bolt 82 is movably coupled to body portion 83 so that latch bolt 82 may be translated along a translation axis between an extended position and a retracted position relative to body portion 83. Latch bolt assembly 78 may be configured so that relative rotation between handle assembly 76 and mounting assembly 74 causes latch bolt 82 to translate relative to body portion 83. Alternatively, latch bolt assembly 78 may be configured so that latch bolt 82 may be extended and retracted regardless of relative rotation between handle assembly 76 and mounting assembly 74, such as by operating a respective lock cylinder 80.

The size and shape of latch bolt cavity 84 are selected so that latch bolt 82 is slidably received therein during operation. When latch bolt 82 is received within cavity 84, that engagement prevents relative motion between door panel 62 and the door jamb. Latch bolt cavity 84 is generally a bore that extends into the door jamb. In the present embodiment, the cross-sectional shape of cavity 84 is rectangular to match the generally rectangular cross-sectional shape of latch bolt 82.

Thus, it is seen that a door panel lock system and method of use are provided. One skilled in the art will appreciate that the present invention can be practiced by other than the preferred embodiments which are presented in this description for purposes of illustration and not of limitation, and the present invention is limited only by the claims that follow. It is noted that equivalents for the particular embodiments discussed in this description may practice the invention as well.

What is claimed is:

1. A door lock assembly comprising:

a mounting assembly fixedly mounted on an outside surface of a door panel;

a handle assembly rotatably coupled to the mounting assembly outside a plane defined by a face of the door panel and including a gripping portion and a latch housing, the latch housing and being located entirely outside the plane of the door panel; and a latch bolt assembly housed entirely within the handle assembly and being located entirely outside the plane of the door panel, the latch bolt assembly including a latch bolt, wherein the latch bolt rotates with the handle assembly such that they are substantially horizontally oriented when the door lock assembly is in a locked position and substantially vertically oriented when the door lock assembly is in an unlocked position, the latch bolt movably coupled to the latch housing such that the latch bolt translates between an extended position wherein the latch bolt at least partially extends from the latch housing and a retracted position wherein the latch bolt is retracted into the latch housing.

2. The door lock assembly of claim 1, wherein the latch bolt assembly comprises a body portion fixedly coupled to the latch housing and the latch bolt is movably coupled to the body portion.

3. The door lock assembly of claim 1, wherein the mounting assembly comprises a mounting plate that comprises lock indicia.

4. The door lock assembly of claim 1, wherein the mounting assembly comprises a pair of mounting plates fixedly coupled to the door panel so that the door panel is interposed between the mounting plates.

5. The door lock assembly of claim 4, wherein the mounting plates comprise lock indicia.

6. The door lock assembly of claim 1, further comprising a lock cylinder disposed within a lock housing of the handle assembly.

7. The door lock assembly of claim 6 wherein the lock cylinder selectively locks the handle assembly to the mounting assembly preventing relative motion between the handle assembly and the mounting assembly.

8. The door lock assembly of claim 6 wherein the lock cylinder selectively translates the latch bolt between the extended position and the retracted position.

9. A door panel assembly, comprising:

a panel member;

a door lock assembly, including:

a mounting assembly fixedly coupled to the panel member, the mounting assembly being located outside a plane defined by a face of the panel member;

a handle assembly rotatably coupled to the mounting assembly outside the plane of the panel member and including a gripping portion and a latch housing, the latch housing being located entirely outside the plane of the panel member; and a latch bolt assembly housed entirely within the handle assembly outside the plane of the panel member, the latch bolt assembly including a latch bolt, wherein the latch bolt rotates with the handle assembly such that they are substantially horizontally oriented when the door lock assembly is in a locked position and substantially vertically oriented when the door lock assembly is in an unlocked position, the latch bolt movably coupled to the latch housing such that the latch bolt translates between an extended position wherein the latch bolt at least partially extends from the latch housing and a retracted position wherein the latch bolt is retracted into the latch housing.

10. The door panel assembly of claim 9, wherein the latch bolt assembly comprises a body portion fixedly coupled to the latch housing and the latch bolt is movably coupled to the body portion.

11. The door panel assembly of claim 9, wherein the mounting assembly comprises a pair of mounting plates, wherein a first mounting plate is fixedly coupled to a first surface of the panel member and a second mounting plate is fixedly coupled to a second surface of the panel member so that the panel member is interposed between the first and second mounting plates.

12. The door panel assembly of claim 9, further comprising a lock cylinder disposed within a lock housing of the handle assembly that selectively locks the handle assembly to the mounting assembly preventing relative motion between the handle assembly and the mounting assembly.

13. A door panel assembly, comprising:

a first panel member pivotable about a first axis of rotation;

a second generally planar panel member pivotable about a second axis of rotation;

a door lock assembly, including:

a first mounting assembly fixedly coupled to the first panel member, the first mounting assembly being located outside a plane defined by a face of the first panel member;

a first handle assembly rotatably coupled to the first mounting assembly outside the plane of the first panel member and including a first gripping portion and a first latch housing being located entirely outside the plane of the first panel member and a plane of the second panel member;

a latch bolt assembly housed entirely within the first handle assembly and being located entirely outside the plane of the first panel member the latch bolt assembly including a latch bolt, wherein the latch bolt rotates with the handle assembly such that they are substantially horizontally oriented when the door lock assembly is in a locked position and substantially vertically oriented when the door lock assembly is in an unlocked position, the latch bolt movably coupled to the first latch housing such that the latch bolt translates between an extended position wherein the latch bolt at least partially extends from the first latch housing and a retracted position wherein the latch bolt is retracted into the first latch housing;

a second mounting assembly fixedly coupled to the second panel member, the second mounting assembly being located outside a plane defined by a face of the second panel member; and a second handle assembly rotatably coupled to the second mounting assembly outside the plane of the second panel member and including a second gripping portion and a second latch housing, the second latch housing being located entirely outside the plane of the second panel member, the second latch housing defining a latch bolt cavity slidably receiving the latch bolt when the first handle assembly is rotated to the locked position, the second handle assembly is rotated to a locked position and the latch bolt is in the extended position.

14. The door panel assembly of claim 13, wherein the latch bolt assembly comprises a body portion fixedly coupled to the first latch housing and the latch bolt is movably coupled to the body portion.

15. The door panel assembly of claim 13, wherein each mounting assembly comprises a pair of mounting plates, wherein a first mounting plate is fixedly coupled to a first surface of the panel member and a second mounting plate is fixedly coupled to a second surface of the panel member so that the panel member is interposed between the first and second mounting plates.

16. The door panel assembly of claim 13, further comprising a lock cylinder disposed within a lock housing of each handle assembly that selectively locks each handle assembly to each mounting assembly preventing relative motion between each handle assembly and each mounting assembly.

17. A door lock assembly for mounting to a panel member, comprising:

a panel member defining a plane parallel to the panel member;

a mounting assembly fixedly mounted on the panel member;

a handle assembly rotatably coupled to the mounting assembly such that the handle assembly is located entirely outside the plane of the panel member and including a gripping portion and a latch housing located entirely outside the plane of the panel member;

a latch bolt assembly housed entirely within the handle assembly such that the latch bolt assembly is located entirely outside the plane of the panel member, the latch bolt assembly including a latch bolt, wherein the latch bolt rotates with the handle assembly outside the plane of the panel member when the handle assembly is rotated such that they are substantially horizontally oriented when the door lock assembly is in a locked position and substantially vertically oriented when the door lock assembly is in an unlocked position, the latch bolt movably coupled to the latch housing such that the latch bolt translates between an extended position wherein the latch bolt at least partially extends from the latch housing and a retracted position wherein the latch bolt is retracted into the latch housing; and an indexing pin assembly extending into the latch bolt assembly and including an indexing pin, the indexing pin assembly in operative connection with the latch bolt assembly such that retracting the indexing pin permits rotation of the handle assembly relative to the mounting assembly.

* * * * *